US007496205B2

(12) United States Patent
Kühnel

(10) Patent No.: US 7,496,205 B2
(45) Date of Patent: Feb. 24, 2009

(54) METHOD FOR ADJUSTING A HEARING DEVICE AS WELL AS AN APPARATUS TO PERFORM THE METHOD

(75) Inventor: Volker Kühnel, Männedorf (CH)

(73) Assignee: Phonak AG, Stafa (CH)

( * ) Notice: Subject to any disclaimer, the term of this patent is extended or adjusted under 35 U.S.C. 154(b) by 656 days.

(21) Appl. No.: 10/731,077

(22) Filed: Dec. 9, 2003

(65) Prior Publication Data

US 2005/0123145 A1 Jun. 9, 2005

(51) Int. Cl.
*H04R 29/00* (2006.01)

(52) U.S. Cl. ..... 381/60; 600/559

(58) Field of Classification Search ..... 381/60, 381/58, 312–331, 59, 23.1; 600/559
See application file for complete search history.

(56) References Cited

U.S. PATENT DOCUMENTS

| | | | | |
|---|---|---|---|---|
| 4,065,647 | A * | 12/1977 | Frye et al. | 381/60 |
| 4,346,268 | A * | 8/1982 | Geerling | 381/58 |
| 5,325,436 | A * | 6/1994 | Soli et al. | 381/313 |
| 5,386,475 | A * | 1/1995 | Birck et al. | 381/320 |
| 5,703,797 | A | 12/1997 | Russell | |
| 5,910,997 | A * | 6/1999 | Ishige et al. | 381/314 |
| 7,024,000 | B1 * | 4/2006 | Gabara et al. | 381/60 |
| 7,058,182 | B2 * | 6/2006 | Kates | 381/60 |
| 2002/0082794 | A1 * | 6/2002 | Kachler et al. | 702/116 |
| 2002/0176584 | A1 * | 11/2002 | Kates | 381/60 |
| 2004/0057591 | A1 * | 3/2004 | Beck et al. | 381/315 |

OTHER PUBLICATIONS

Levitt, H. et al. "A Computerized Hearing Aid Measurement/Simulation System" Hearing Instruments, Har5court Brace Jovanovich Publ. Duluth, MN, Bd. 37, Nr. 2, Feb. 1986, pp. 16-18 XP000796054, ISSN: 0092-4466.

Granados, P. et al. "Improved White Noise Method in the Evaluation of Linear Hearing-Aids Characteristics" Medical Progress Through Technology, Springer Verlag. Berlin, DE, Bd. 20, Nr. 1/2, 1994, pp. 37-42, XP000459483, ISSN: 0047-6552.

* cited by examiner

*Primary Examiner*—Vivian Chin
*Assistant Examiner*—Disler Paul
(74) *Attorney, Agent, or Firm*—Pearne & Gordon LLP

(57) ABSTRACT

A method and an apparatus for adjusting a first hearing device based on adjustments of a second hearing device are disclosed. The method comprises the steps of converting an acoustic test signal into an electric test signal by a microphone of the second hearing device, of converting an acoustic signal generated by a receiver of the second hearing device into an electrical signal, of analyzing the electrical signal in an analyzing unit, and, finally, of adjusting the first hearing device based on results obtained in the analysis performed in the analyzing unit. By the present invention, an especially suitable procedure for performing the initial adjustment of a new hearing device is achieved. The method according to the present invention quickly leads to spontaneous user acceptance of the newly adjusted (i.e. fitted) hearing device, whilst considerably reducing the required fitting effort compared with today's state of the art techniques.

15 Claims, 1 Drawing Sheet

METHOD FOR ADJUSTING A HEARING DEVICE AS WELL AS AN APPARATUS TO PERFORM THE METHOD

FIELD OF THE INVENTION

The present invention is related to a method for adjusting a first hearing device based on adjustments of a second hearing device, as well as to an apparatus for performing said method.

BACKGROUND OF THE INVENTION

When an experienced hearing device user replaces a hearing device, he or she has been used to, with a new hearing device, the new hearing device is adjusted (i.e. "fitted") to the user's specific hearing impairment according to the same method as employed for a first time user, i.e. the hearing device settings are determined based on measurements of the corresponding user's personal audiogram. In practice, however, it has been shown that, especially for longtime users, the desired hearing device settings—such as gain, compression, limiting, knee-point or time constants—often deviate heavily from those derived from measurements of the user's audiogram. With the transition to a new hearing device, the experienced user would like to have the new hearing device adjusted in such a way that the settings match those of his or her old hearing device as closely as possible. In particular for users with a profound hearing loss, the required gain can depart by up to 20 dB from the target value calculated on the basis of the person's audiogram. In such cases a different approach for pre-adjusting the hearing device is desirable, namely one that is not based solely on the user's audiogram.

Reports from actual experience have revealed that adjustment of a new hearing device according to the settings of a user's prior hearing device represents a very effective and successful method of pre-adjustment, which Is often superior to schemes based solely on the user's audiogram.

Presently, no automated procedure is known which supports the above-mentioned method for pre-adjusting a new hearing device. One possible approach could consist of using a designated measurement apparatus to apply a test signal with various input levels to the user's old hearing device and record its response. Subsequently, these measurement results would have to be manually transferred to the fitting software required to appropriately adjust the new hearing device. This process would be very tedious and error-prone.

The object of the present invention is thus to provide a simple and efficient method to adjust a first hearing device based on the settings of a second hearing device.

SUMMARY OF THE INVENTION

A method and an apparatus for adjusting a first hearing device based on adjustments of a second hearing device are disclosed. The method comprises the steps of converting an acoustic test signal into an electric test signal by a microphone of the second hearing device, of converting an acoustic signal generated by a receiver of the second hearing device into an electrical signal, of analyzing the electrical signal in an analyzing unit, and, finally, of adjusting the first hearing device based on results obtained in the analysis performed in the analyzing unit.

By the present invention, an especially suitable procedure for performing the initial adjustment of a new hearing device is achieved. The method according to the present invention quickly leads to spontaneous user acceptance of the newly adjusted (i.e. fitted) hearing device, whilst considerably reducing the required fitting effort compared with today's state of the art techniques. Additionally, the audiologist can perform the initial fitting of the new hearing device in substantially less time.

BRIEF DESCRIPTION OF THE DRAWINGS

In the following, the present invention will be further explained by referring to two drawings depicting an exemplified embodiment of the present invention. It is shown in.

DETAILED DESCRIPTION OF EMBODIMENTS OF THE PRESENT INVENTION

Figure 1:
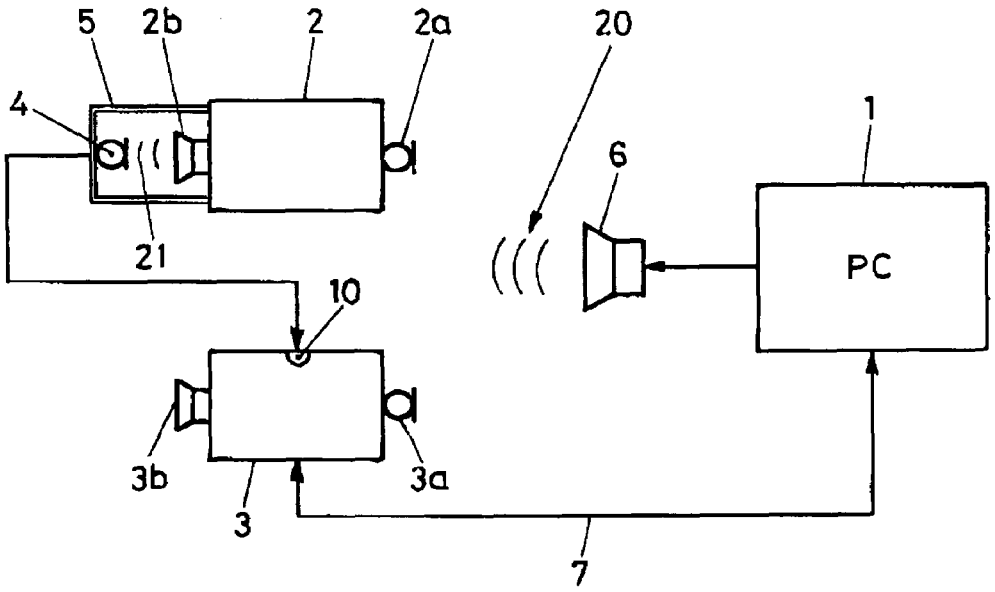
FIG. 1, schematically, an apparatus according to the present invention with a first hearing device requiring initial adjustment, a second previously adjusted hearing device as well as a control unit, and FIG. 2 a modified variant of the preferred embodiment according to FIG. 1.

FIG. 1 shows a control unit 1, a hearing device 2, which will be referred to as the second hearing device and whose settings have been adjusted according to the requirements of a specific hearing device user, and a further hearing device 3, which is functionally connected to the second hearing device 2 and which will be referred to as the first hearing device. The control unit 1, which for example could be a standard personal computer (PC) essentially comprising an input/output unit and a processing unit, executes a fitting program which allows the audiologist to quickly and easily adjust a certain hearing device to a specific hearing device user's hearing impairment. For this purpose, the control unit 1 is connected, on the one hand, to a loudspeaker 6 with the help of which acoustic test signals 20 are generated, and, on the other hand, with the first hearing device 3 via a connecting cable 7. The first hearing device 3 is equipped with a microphone 3*a* and a receiver 3*b*. Furthermore, the first hearing device 3 has an audio input via which an audio signal can be supplied to the device.

The second hearing device 2 also features a microphone 2*a* as well as a receiver 2*b*, the latter being completely covered by a coupler element 5 such that a cavity is formed. In this cavity, a measurement microphone 4 is arranged whose output signal is fed to the audio input 10 of the first hearing device 3. A known couple element for use in the present invention is described in the publication Phonak Focus number 20 entitled "The Desired Sensation Level (DSL) Method for Hearing Aid Fitting in Infants and Children" (Richard C. Seewald, 1995), for example. An identical publication is contained in the brochure entitled "DSL 4.0 Handbook" by the same author.

As previously described, the aim of the present invention is to find hearing device settings for the first hearing device 3, which are as close as possible to those of the second hearing device 2. Therewith, a high level of spontaneous acceptance can be achieved the first time the user wears the first hearing device 3. These initial hearing device settings are an excellent starting point for further fine tuning and optimization of the hearing device settings.

The method according to the present invention is described in the following;

In a first embodiment of the present invention, the first hearing device 3 is put into a so-called measurement mode at the beginning of the fitting process, in which measurement mode the transfer characteristics of the second hearing device 2 are determined and transferred to the control unit 1. The fitting software, which is being executed by the control unit 1, transforms the received information into a parameter set that can be interpreted by the first hearing device 3. Furthermore, the entire process of adjusting the first hearing device 3 is controlled and monitored by the fitting software. Likewise, all possible instructions or error messages are displayed to the audiologist by the control unit 1.

The control unit 1 can, for example, employ a standard sound card—as commonly used in personal computers—to drive the loudspeaker 6.

As mentioned previously, the second hearing device 2 is connected to a couple element 5 with known transfer function which contains a measurement microphone 4, preferably in the form of a probe microphone (according to IEC standard 126: 2 cc coupler HA-1 for ITE, i.e. in-the-ear hearing devices, or HA-2 for BTE, i.e. behind-the-ear hearing devices). The output signal from the measurement microphone 4 is applied to the audio input 10 of the first hearing device 3 where it is analyzed. A filter bank built into the first hearing device 3 for signal processing in normal mode can be used for analyzing the signal present at the audio input 10 in measurement mode. At the same time, the microphone 3*a* of the first hearing device 3 picks up the sound 20 from the loudspeaker 6 and acts as a reference microphone to determine the loudness or the sound pressure level, respectively, and to control via the control unit 1 the sound emission 20 from the loudspeaker 6. This also makes it possible to calibrate the first hearing device 3. Hereby, the two hearing devices 2 and 3 should be placed in close proximity to one another such that both are exposed to the same sound emission. Furthermore, an optimal fitting of the first hearing device 3 can only be achieved if no acoustic interference signals are picked up by the microphones 2*a* and 3*a*. Therefore, it is advantageous to place the entire configuration into a sound-absorbing chamber. In addition, it is envisaged that noise and other interference can be detected by an appropriate algorithm in the control unit 1 so that erroneous measurement data can be eliminated (artifact rejection).

Different acoustic test signals 20, such as white noise with various sound levels, are now presented to this configuration. Alternatively, sine tones, chirp/wobble signals as well as speech signals or music can also be used as possible test signals. By recording acoustic signals 21 that originate from the receiver 2*b* in the coupler element 5 and are picked up by the measurement microphone 4, the transfer function of the second hearing device 2 can be determined in the first hearing device 3. In addition, transient test signals 20 (e.g. level jumps) can be employed to evaluate the temporal behavior such as time constants of the utilized compression.

Based on this measurement data, the first hearing device 3 can now be adjusted such that the transfer function of the first and second hearing device 2 and 3, respectively, become as similar as possible.

It is pointed out that the second hearing device 2, which is to be measured, can be any hearing device. The "new", first hearing device 3 must feature a sufficient frequency resolution and possess an audio input 10 to which the measurement microphone 4 can be connected in a simple manner.

The measurements takes place in a room where it is as quiet as possible—which is also necessary when measuring the feedback threshold of a hearing device or the hearing threshold of a hearing impaired person. This requirement is met offhand in the facilities used by an audiologist to perform measurements.

The second hearing device 2 is attached to the coupler element 5, which for example can be a so-called "2 cc coupler". The 2 cc coupler is defined according to the IEC standard 126 (see aforementioned reference by Richard C. Seewald), whereby other couplers may be employed as long as a defined cavity is present in conjunction with an appropriate connection since a conversion to the standardized 2 cc values is always possible. Instead of a standard microphone an adapter with a channel for a probe tube is inserted into the coupler element 5. The actual measurement microphone consists, for example, of a RECD—(i.e. real-ear-to-coupler difference) direct audio shoe (again refer to IEC standard 126 or the reference by Richard C. Seewald cited above) whose probe tube protrudes into the 2 cc cavity via the adapter.

According to a preferred embodiment of the present invention, the first and second hearing device 2 and 3, respectively, are placed on a flat surface such that the microphones 2*a* and 3*a* of the two hearing devices 2 and 3, respectively, are in close proximity to one another. The loudspeaker 6, which is the sound source used to generate the test signals 20, is located at a distance of approximately 50 cm away from the microphones 2*a* and 3*a*.

As previously mentioned, stationary or speech-modulated white noise or ICRA noise are reproduced by the loudspeaker 6 for the measurement. A definition of ICPA noise is given in the paper by W. A. Dreschler, H. Verschuure, C. Ludvigsen, and S. Westermann entitled "ICPA Noises: Artificial Noise Signals with Speech-like Spectral and Temporal Properties for Hearing Aid Assessment", (*Audiology,* Vol. 40, No. 3, May-June 2001, pp. 148-157). The test signals 20 are generated by the sound card of the personal computer, which is acting as the control unit 1, and are delivered to the loudspeaker 6.

In order to calibrate the first hearing device 3, the loudspeaker 6 reproduces a test signal 20 consisting of stationary white noise. Mean input level values computed within the first hearing device 3 are read out and, if necessary, the spectral characteristics and the level of the generated sound signal are corrected based on these readings as long as the adjustments are not too large. otherwise the audiologist is informed that the quality of the signal reproduced by the loudspeaker is insufficient. If a spectral correction via the control unit 1 is not possible, the method can nevertheless be performed, although the significance of the results is somewhat limited in this case.

Before and after calibration of the sound emission level, the level of the spectral background noise in the test room is determined according to the same procedure. If this noise level is too high the audiologist is notified accordingly, for example by the control unit 1.

For example, a first measurement consist of reproducing modulated noise via the loudspeaker 6 (see above) as an acoustic test signal 20, whereby the signal level takes on values of 50, 65 and 80 dB in succession. In the couple element 5, the response of the second hearing device 2 is captured. This specific response is representative of the reproduction of modulated signals such as speech.

A second measurement, for example, consists of reproducing unmodulated noise via the loudspeaker 6 (see above) as an acoustic test signal 20, whereby the signal level is set to a value 65 dB. In the couple element 5, the response of the second hearing device 2 is captured. This response is representative for the reproduction of stationary noise. The degree of noise cancellation can be determined from the difference between the results of the first and second measurement.

If required, a third measurement consist, for example, of reproducing unmodulated noise via the loudspeaker 6 as an acoustic test signal 20, whereby the signal level jumps by 25 dB in the middle of a test sequence (e.g. beginning with 55 dB, then jumping to 80 dB, and then jumping back to 55 dB at the end). From the response captured in the couple element 5, the order of magnitude of the settling time constant and the decay can be determined.

An alternative third measurement consist, for example, of reproducing a real speech signal or an equivalently modulated noise signal with an output level of 65 dB via the loudspeaker 6 as an acoustic test signal 20 (see above). By analyzing the amplitude distribution function (i.e. histogram) of the captured signal, the effective dynamic compression as well as the time constants of the compression scheme can be determined. This will be explained further in the following.

The effective dynamic compression of a signal is determined as follows: At first, the dynamic range of the input signal of a typical modulated signal such as a speech signal with a sound pressure level (SPL) of 65 dB is determined. The value of the dynamic range is obtained, for example, by calculating the difference between the $10^{th}$ and $95^{th}$ percentile of the measured amplitude density function. Subsequently, the signal captured by the microphone 2*a* and processed by the second hearing device 2 is analyzed in the same way. The ratio of the dynamic range value obtained first and the subsequently obtained dynamic range value yields the effective compression ratio of the signal processing performed by the second hearing device 2.

If additionally the same measurements are performed with an unmodulated signal, the ratio of the obtained results yields the static compression ratio.

On the other hand, the time constants of the compression control loop may be determined as follows:

One calculates the modulation spectra of a signal processed by the second hearing device 2 for a speech signal or a speech-like modulated signal as well as for the same unprocessed signal. Since a dynamic compression control loop acts as a high pass filter, the difference between the above mentioned modulation spectra typically exhibits a high pass characteristic with a certain cutoff frequency. This cutoff frequency is a direct measure of the time constants of the control loop of the utilized compression scheme.

The results of the first measurement are employed to set the input/output functions of the different channels. The difference between the second and the first measurement is used to set the degree of noise canceling. If the time constants of the gain control loop belong to the fitting parameters, the third measurement can be used to adjust the settling time.

If the hearing devices include different selectable hearing programs, these different hearing programs are successively activated in the second hearing device 2 which is to be measured, and the above described measurement procedure is repeated for each possible hearing program individually.

Preferably, the volume control setting of the second hearing device 2, which is to be measured, should be adjusted such that it is suitable for situations characterized by medium sound levels. This implies a customer setting which is suitable for comfortable listing in quiet surroundings. With digital hearing devices, this is typically the setting selected immediately after turning on the hearing device.

If the limiter setting of the hearing device, which is being measured, also needs to be determined, the second hearing device 2 additionally has to be exposed to a 90 dB SPL test signal and the previously describe measurement procedure has to be executed. A 90 dB SPL signal is typically very unpleasant for both the audiologist as well as the hearing device user.

Figure 2:
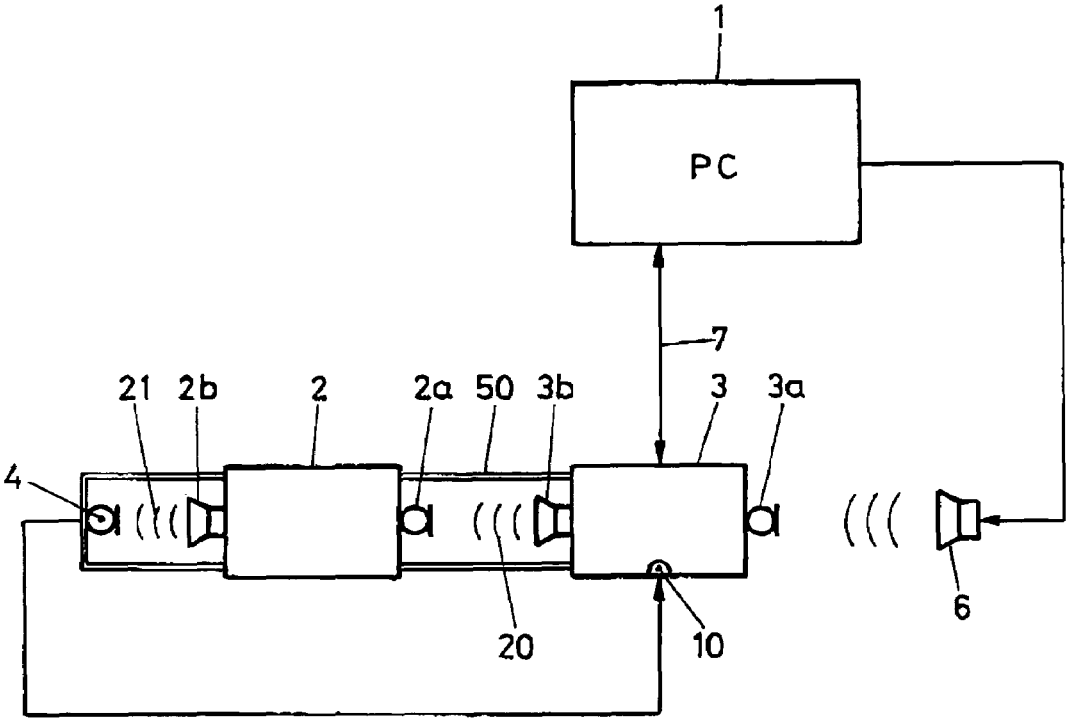

FIG. 2 depicts another embodiment of the present invention, whereby this embodiment merely differs from the one shown in FIG. 1 in the aspect that the acoustic test signal 20 is generated with the help of the first hearing device 3. To accomplish this, a further coupler element 50 is required between the second and the first hearing device 2 and 3, respectively. The loudspeaker 6 is only needed for the above mentioned calibration process. The main part of the signal processing is now executed in the first hearing device 3 under control of the control unit 1. Otherwise, the same measurement procedures as described in conjunction with the configuration presented in FIG. 1 are utilized; hence no additional explanations are required that are specific to this second preferable embodiment of the present invention.

The invention claimed is:

1. An apparatus comprising:
a first hearing device;
a second hearing device;
a loudspeaker generating an acoustic test signal;
a couple element including a measurement microphone; and
a control unit is connected to the loudspeaker; wherein
the acoustic test signal is fed to a microphone of the second hearing device in which another acoustic signal is generated that is recorded by the measurement microphone of the couple element, the measurement microphone being connected to the first hearing device which is connected to the control unit.

2. The apparatus of claim 1, wherein a further couple element is provided to couple a receiver of the first hearing device with a microphone of the second hearing device.

3. The apparatus of claim 1 or 2, wherein the acoustic test signal is a stationary or a speech-modulated noise.

4. The apparatus of claim 1 or 2, wherein the acoustic test signal is an un-modulated noise with a sound-level step of preferably 15 dB.

5. The apparatus of claim 1 or 2, wherein the acoustic test signal has a sound-level of at least 90 dB.

6. The apparatus of claim 1, wherein the adjustment in the first hearing device is applied to all available hearing programs.

7. An apparatus comprising:
a first hearing device;
a second hearing device;
a couple element including a measurement microphone;
a further couple element; and
a control unit; wherein
a receiver of the first hearing device is coupled to the microphone of the second hearing device by the further couple element and the receiver of the second hearing device is coupled to the measurement microphone of the couple element, the measurement microphone being connected to the first hearing device, and the control unit being connected to the first hearing device.

8. The apparatus of claim 7, wherein a loudspeaker is operatively connected to the control unit.

9. The apparatus of claim 7 or 8, wherein the acoustic test signal is a stationary or a speech-modulated noise.

10. The apparatus of claim 7 or 8, wherein the acoustic test signal is an un-modulated noise with a sound-level step of preferably 15 dB.

11. The apparatus of claim 7 or 8, wherein the acoustic test signal has a sound-level of at least 90 dB.

12. The apparatus of claim 7, wherein the adjustment in the first hearing device is applied to all available hearing programs.

13. The apparatus of claim 7, wherein said control unit is adapted to utilize said couplings such that settings of said first hearing device are adjusted to closely match settings already present in said second hearing device.

14. The apparatus of claim 1, wherein said control unit is adapted to utilize results from said another acoustic test signal for adjusting settings of said first hearing device to closely match settings already present in said second hearing device.

15. An system comprising:

a control unit;

a speaker for generating an acoustic test signal based on an input from said control unit;

a second hearing device including a second microphone for receiving said acoustic test signal and also including a speaker for generating an acoustic output signal from said acoustic test signal, said acoustic output signal based on a second transfer function of said second hearing device;

a coupler including a third microphone for receiving said acoustic output signal from said second hearing device, said coupler being acoustically connected to said second hearing device by a known transfer function;

a first hearing device including a first microphone and an audio input electrically connected to said third microphone; and an analyzing unit for analyzing wherein said control unit is external to said first and said second hearing device, and wherein said control unit is connected to said first hearing device via a control connection for controlling the adjustment of a first transfer function of said first hearing device based on said acoustic output signal of said second hearing device.

* * * * *

UNITED STATES PATENT AND TRADEMARK OFFICE

CERTIFICATE OF CORRECTION

PATENT NO. : 7,496,205 B2
APPLICATION NO. : 10/731077
DATED : February 24, 2009
INVENTOR(S) : Volker Kuhnel It is certified that error appears in the above-identified patent and that said Letters Patent is hereby corrected as shown below:

In the specification, column 4, line 20, replace "ICPA" with -- ICRA --.

In the specification, column 4, line 22, replace "ICPA" with -- ICRA --.

Signed and Sealed this

Eleventh Day of August, 2009

David J. Kappos

David J. Kappos
*Director of the United States Patent and Trademark Office*